US011912485B2

(12) United States Patent
Klavdianos et al.

(10) Patent No.: US 11,912,485 B2
(45) Date of Patent: Feb. 27, 2024

(54) PACKAGING DEVICE AND METHOD

(71) Applicant: BIC VIOLEX SINGLE MEMBER S.A., Anoixi (GR)

(72) Inventors: Dionysios Klavdianos, Anoixi (GR); Andreas Vasileiadis, Anoixi (GR)

(73) Assignee: BIC Violex Single Member S.A., Anoixi (GR)

( * ) Notice: Subject to any disclaimer, the term of this patent is extended or adjusted under 35 U.S.C. 154(b) by 0 days.

(21) Appl. No.: 17/755,129

(22) PCT Filed: Nov. 27, 2020

(86) PCT No.: PCT/EP2020/083730

§ 371 (c)(1),
(2) Date: Apr. 21, 2022

(87) PCT Pub. No.: WO2021/105426

PCT Pub. Date: Jun. 3, 2021

(65) Prior Publication Data

US 2022/0380103 A1 Dec. 1, 2022

(30) Foreign Application Priority Data

Nov. 29, 2019 (EP) ..... 19212494

(51) Int. Cl.
*B65D 73/00* (2006.01)

(52) U.S. Cl.
CPC ..... *B65D 73/0071* (2013.01); *B65D 73/0085* (2013.01); *B65D 2575/565* (2013.01)

(58) Field of Classification Search
CPC ..... B65D 77/02; B65D 73/0071; B65D 73/0085; B65D 2575/565; B65D 73/00;
(Continued)

(56) References Cited

U.S. PATENT DOCUMENTS 4,140,244 A 2/1979 Clabby
4,888,868 A 12/1989 Pritchard
(Continued)

FOREIGN PATENT DOCUMENTS

DE 9205046 U1 6/1992
DE 102007014895 A1 10/2007
(Continued)

OTHER PUBLICATIONS

European Search Report issued in European Application EP19212494.9 dated May 26, 2020 (6 pages).
(Continued)

*Primary Examiner* — Anthony D Stashick
*Assistant Examiner* — Raven Collins
(74) *Attorney, Agent, or Firm* — Bookoff McAndrews, PLLC

(57) ABSTRACT

A packaging for a product comprising a support having a first side and a second side and a first edge and a second edge, the support defining one or more indents; and a retainer extending from the support and including an engagement surface, the retainer having a first position wherein the engagement surface cooperates with the one or more indents to define a cavity between the retainer and the first side of the support and a second position wherein the engagement surface is withdrawn from the one or more indents, and the retainer is configured to engage the product within the cavity in the first position and disengage the product within the cavity in the second position.

19 Claims, 5 Drawing Sheets

(58) Field of Classification Search
CPC ..... B65D 73/005; B65D 73/0035; B65D 73/0014; B65D 75/30
USPC ..... 206/462
See application file for complete search history.

(56) References Cited

U.S. PATENT DOCUMENTS

| | | | | |
|---|---|---|---|---|
| 5,090,570 | A * | 2/1992 | Todd | B65D 75/22 206/463 |
| 6,520,328 | B2 | 2/2003 | Ortiz | |
| 6,857,521 | B2 | 2/2005 | Cantu-Gonzalez | |
| 9,371,153 | B1 * | 6/2016 | Nouri | B65D 75/322 |
| 2001/0047948 | A1 | 12/2001 | Cummings et al. | |
| 2004/0226842 | A1 | 11/2004 | O'Toole | |
| 2006/0000738 | A1 * | 1/2006 | Kumakura | B65D 75/38 206/470 |
| 2012/0103362 | A1 | 5/2012 | Nowacek | |
| 2016/0016712 | A1 | 1/2016 | Su | |
| 2019/0283921 | A1 | 9/2019 | Stamoulis et al. | |

FOREIGN PATENT DOCUMENTS

| | | | | |
|---|---|---|---|---|
| EP | 2505515 | A1 * | 10/2012 | B65D 25/10 |
| FR | 2722173 | A1 * | 1/1996 | B65D 73/0014 |
| GB | 2218368 | A | 11/1989 | |
| JP | 2007161344 | A | 6/2007 | |
| WO | 1996022237 | A1 | 7/1996 | |

OTHER PUBLICATIONS

International Search Report and Written Opinion issued in International Application PCT/EP2020/083730 dated Jan. 29, 2021 (13 pages).
Crusoe Treasure Wines, Jan. 23, 2013, https://www.pinterest.com/pin/338473728221835501/ (4 pages).
Communication issued in corresponding European Application No. 19 212 494.9 dated Mar. 3, 2023 (4 pages).

* cited by examiner

PACKAGING DEVICE AND METHOD

CROSS-REFERENCE TO RELATED APPLICATIONS

This application is a National Stage Application of International Application PCT/EP2020/083730, filed on Nov. 27, 2020, now published as WO 2021/105426 A1, and which claims priority to European Patent Application 19212494.9, filed on Nov. 29, 2019, which is incorporated by reference herein in its entirety.

FIELD

The present disclosure relates generally to the field of packaging, and in particular to a packaging device for a product to be marketed, promoted, and sold. More specifically, the present disclosure relates to a display packaging device for a handheld shaving device.

BACKGROUND ART

When marketing, promoting, and selling a product, the packaging for the product should clearly convey to potential consumers what the product is and where the product can be found. Currently, many products are displayed in single-use plastic packaging meant for specific, short-term usage before being recycled or disposed of and/or in packaging which uses excess materials. The usage of plastic and/or excess materials to display a product is both harmful to the environment and causes consumer frustration—as it is common for consumers to be conscious of the environment, unable to easily open the packaging, and unsure of where to find the product based upon the information presented on the packaging.

An example is U.S. Pat. No. 9,371,153 B1 which discloses a container made of an elastomer such as silicone with an integrated leak-resistant seal. The seal incorporates press-fit elements with sizes and shapes sufficient to provide a strong seal that resists leakage of liquids from inside the container. The seal is integrated into the container and requires no external clips or clasps. Additional features are provided to facilitate opening such as extended flaps for pulling the sides open, and asymmetric cavities for press-fit elements to reduce the initial opening force.

Another example is DE102007014895 A1 which discloses a suspension device that takes hold of a profiled rail either directly or indirectly and has a through-hole, into which a pin can be plugged so as to penetrate a hole drilled in the profiled rail so as to form a detachable link between it and the suspension device.

Another example is DE9205046 U1 which discloses a package for an article comprising an elongated, rod-shaped section, such as a radio or a car antenna, with a closed receiving housing having a front wall, side walls, a rear wall, a bottom and a top end surface, wherein the rear wall has an upwardly extended section beyond the upper end surface.

It is desirable to provide an improved packaging in a manner that fulfills one or more of the needs described above.

SUMMARY

According to aspects of the present disclosure, a packaging (hereafter, "the packaging") for a product comprises a support and a retainer, the support has a first side and a second side. The first and second side extend laterally between a first edge and an opposing second edge and longitudinally between a proximal end and a distal end, the support defines one or more indents, the retainer extends from the support and includes an engagement surface, the retainer configured to adopt a first position wherein the engagement surface cooperates with the one or more indents to define a cavity between the retainer and the first side of the support and a second position wherein the engagement surface no longer cooperates with the one or more indents, and the retainer is configured to hold the product within the cavity in the first position and release the product within the cavity in the second position.

According to aspects of the present disclosure, the retainer may comprise an elastomer.

According to aspects of the present disclosure, the retainer may be connected to the support.

According to aspects of the present disclosure, the support may include a proximal end and a distal end and a securing member positioned on the first side of the support between the proximal and distal ends.

According to aspects of the present disclosure, the securing member may extend from the first edge to the second edge.

According to aspects of the present disclosure, a first indent may be defined at the first edge and a second indent may be defined at the second edge.

According to aspects of the present disclosure, the packaging may comprise a mounting segment positioned on and/or above the support. In examples, the mounting segment may comprise an aperture.

According to aspects of the present disclosure, the support may include a bulge at or above the one or more indents.

According to aspects of the present disclosure, in the first position of the retainer the engagement surface cooperates with the second side of the support and in the second position of the retainer the engagement surface no longer cooperates with the second side of the support.

According to aspects of the present disclosure, the retainer may include a base affixed to the support and a band extending from the base. In examples, the band may be configured to press the product against the first side of the support.

According to aspects of the present disclosure, a method of making a packaging for a product is provided. The method comprises a step of providing a support having a first side and a second side. The first and second sides extend laterally between a first edge and an opposing second edge and extend longitudinally between a proximal end and a distal end. The method further comprises a step of defining one or more indents on the support, and a step of extending a retainer having an engagement surface from the support, the retainer having a first position wherein the engagement surface cooperates with the one or more indents to define a cavity between the retainer and the first side of the support and a second position wherein the engagement surface is withdrawn from the one or more indents, and the retainer is configured to engage the product within the cavity in the first position and disengage the product within the cavity in the second position.

According to aspects of the present disclosure, the method step of extending a retainer may include the retainer connecting to the support.

According to aspects of the present disclosure, the method may further comprise a step of including a securing member on the first side of the support.

According to aspects of the present disclosure, the method step of extending a retainer may include the engagement surface cooperating with the second side of the support in the first position and the engagement surface withdrawing from the second side of the support in the second position.

According to aspects of the present disclosure, the method step of extending a retainer may include the retainer comprising an elastomer.

According to aspects of the disclosure, a method of engaging a product within a packaging is provided. The method comprises a step of providing a support having a first side and a second side and a first edge and a second edge, the support defining one or more indents, a step of extending a retainer having an engagement surface from the support, the retainer having a first position wherein the engagement surface cooperates with the one or more indents to define a cavity between the retainer and the first side of the support and a second position wherein the engagement surface no longer cooperates with the one or more indents, a step of positioning the product between the first side of the support and the retainer, and a step of transitioning the retainer from the second position to the first position, the retainer configured to hold the product within the cavity in the first position.

According to aspects of the present disclosure, the method step of extending the retainer may include the retainer connecting to the support.

According to aspects of the present disclosure, the method may further comprise a step of including a securing member on the first side of the support.

According to aspects of the present disclosure, the method step of extending a retainer may include the engagement surface cooperating with the second side of the support in the first position and the engagement surface no longer cooperating with the second side of the support in the second position.

According to aspects of the present disclosure, the method step of extending a retainer may include the retainer comprising an elastomer.

In the manner described and according to aspects illustrated herein, the packaging may be configured to display the product while addressing one or more needs such as reducing the usage of harmful materials and/or excess materials, reducing difficulty in opening the packaging, and improving presentation of information on the packaging.

BRIEF DESCRIPTION OF THE DRAWINGS

Aspects of an embodiment will be described in reference to the drawings, where like numerals reflect like elements.

DETAILED DESCRIPTION

Figure 1A:
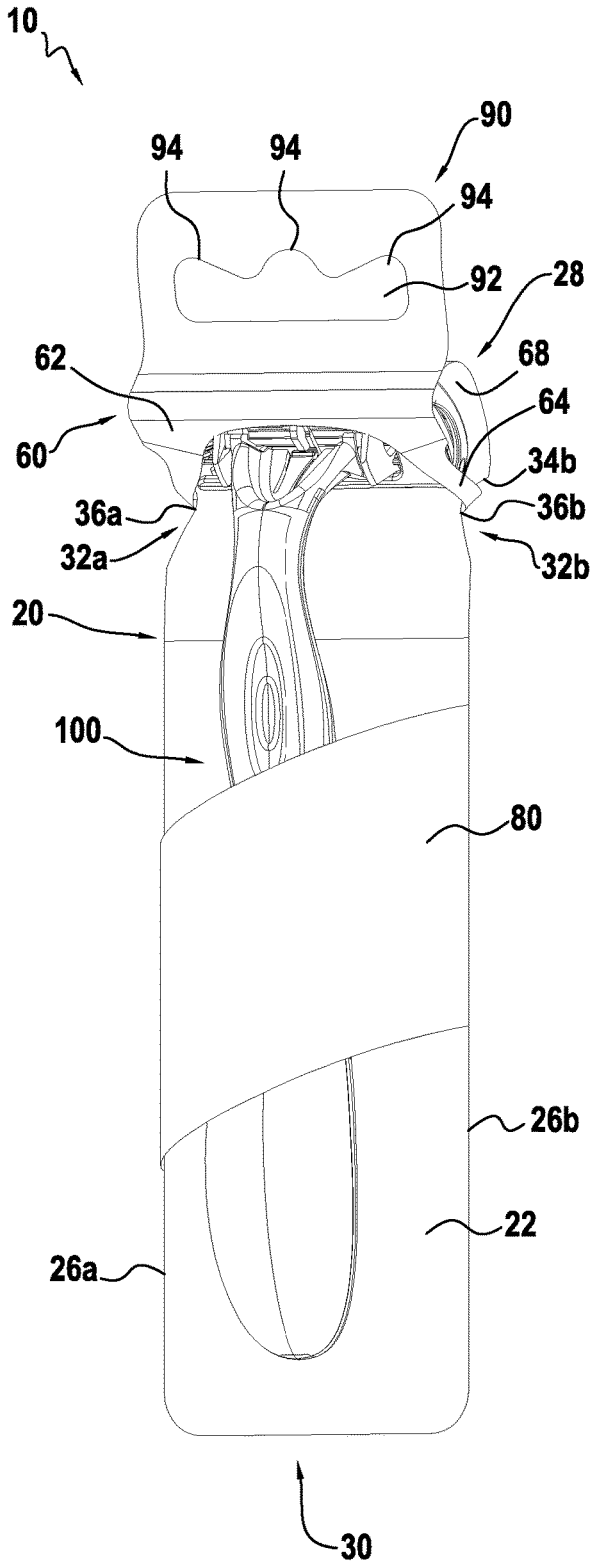
FIG. 1A is a front perspective view of the packaging according to aspects of the disclosure.

An embodiment of the packaging according to aspects of the disclosure will now be described with reference to FIGS. 1A-5, wherein like numerals represent like parts, and will generally be referred to by the reference numeral 10. Although the packaging 10 is described with reference to specific examples, it should be understood that modifications and changes may be made to these examples without going beyond the general scope as defined by the claims. In particular, individual characteristics of the various embodiments shown and/or mentioned herein may be combined in additional embodiments. Consequently, the description and the drawings should be considered in a sense that is illustrative rather than restrictive. The Figures, which are not necessarily to scale, depict illustrative aspects and are not intended to limit the scope of the disclosure. The illustrative aspects depicted are intended only as exemplary.

The term "exemplary" is used in the sense of "example," rather than "ideal." While aspects of the disclosure are amenable to various modifications and alternative forms, specifics thereof have been shown by way of example in the drawings and will be described in detail. It should be understood, however, that the intention is not to limit aspects of the disclosure to the particular embodiment(s) described. On the contrary, the intention of this disclosure is to cover all modifications, equivalents, and alternatives falling within the scope of the disclosure.

Various materials, methods of construction and methods of fastening will be discussed in the context of the disclosed embodiment(s). Those skilled in the art will recognize known substitutes for the materials, construction methods, and fastening methods, all of which are contemplated as compatible with the disclosed embodiment(s) and are intended to be encompassed by the appended claims.

As used in this disclosure and the appended claims, the singular forms "a," "an," and "the" include plural referents unless the content clearly dictates otherwise. As used in this disclosure and the appended claims, the term "or" is generally employed in its sense including "and/or" unless the content clearly dictates otherwise.

Throughout the description, including the claims, the terms "comprising a," "including a," and "having a" should be understood as being synonymous with "comprising one or more," "including one or more," and "having one or more" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially," "approximately," and "generally" should be understood to mean falling within such accepted tolerances.

When an element or feature is referred to herein as being "on," "engaged to," "connected to," or "coupled to" another element or feature, it may be directly on, engaged, connected, or coupled to the other element or feature, or intervening elements or features may be present. In contrast, when an element or feature is referred to as being "directly on," "directly engaged to," "directly connected to," or "directly coupled to" another element or feature, there may be no intervening elements or features present. Other words used to describe the relationship between elements or features should be interpreted in a like fashion (e.g., "between" versus "directly between," "adjacent" versus "directly adjacent," etc.).

Spatially relative terms, such as "top," "bottom," "middle," "inner," "outer," "beneath," "below," "lower," "above," "upper," and the like, may be used herein for ease of description to describe one element or feature's relationship to another element(s) or feature(s) as illustrated in the drawings. Spatially relative terms may be intended to encompass different orientations of a device in use or operation in addition to the orientation depicted in the drawings. For example, if the device in the drawings is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although the terms "first," "second," etc. may be used herein to describe various elements, components, regions, layers, sections, and/or parameters, these elements, components, regions, layers, sections, and/or parameters should not be limited by these terms. These terms are only used to distinguish one element, component, region, layer, or section from another region, layer, or section. Thus, a first element, component, region, layer, or section discussed herein could be termed a second element, component, region, layer, or section without departing from the teachings of the present disclosure.

Figure 1B:
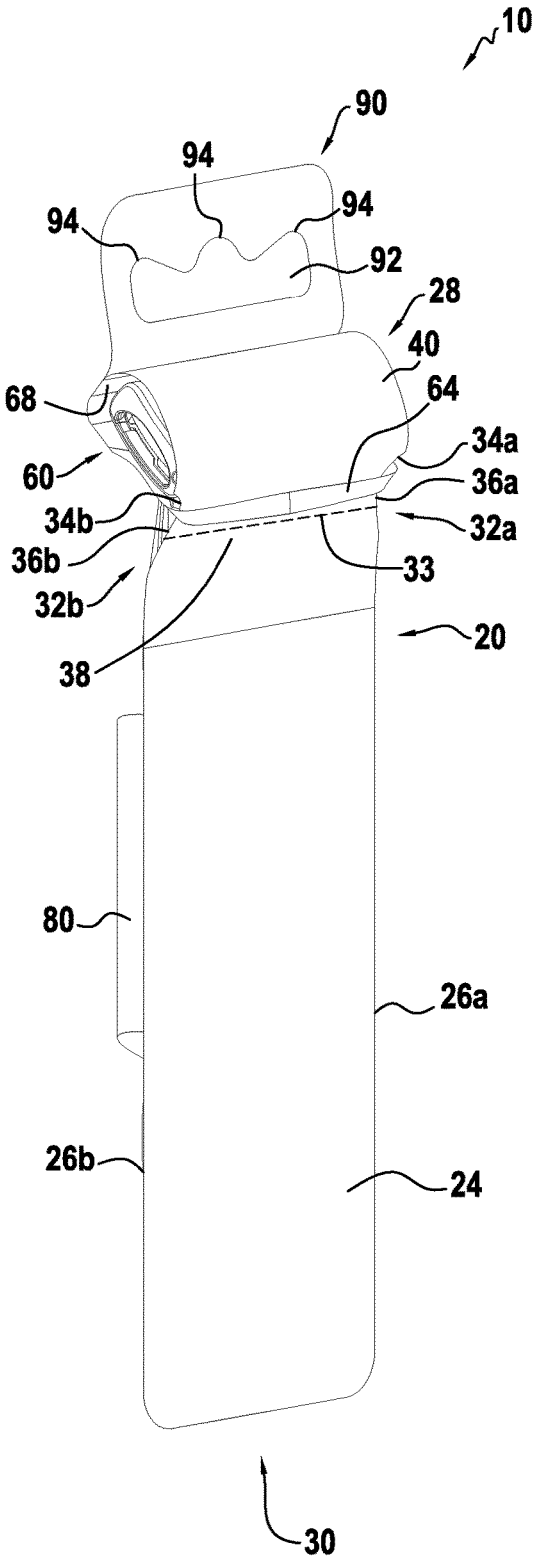
FIG. 1B is a rear perspective view of the packaging of FIG. 1A.
Figure 2A:
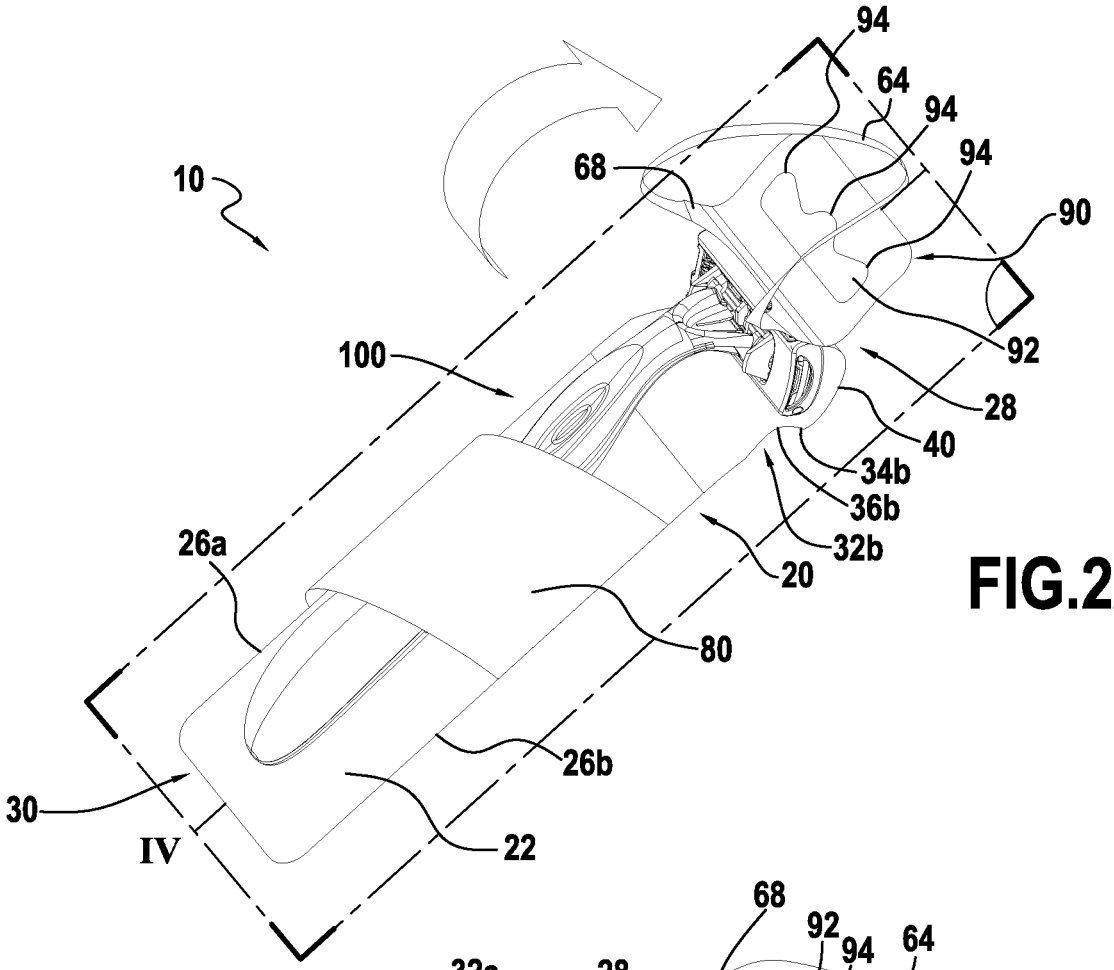
FIG. 2A is a front perspective view of the packaging of FIG. 1A, illustrating a retainer of the packaging in a second position.
Figure 2B:
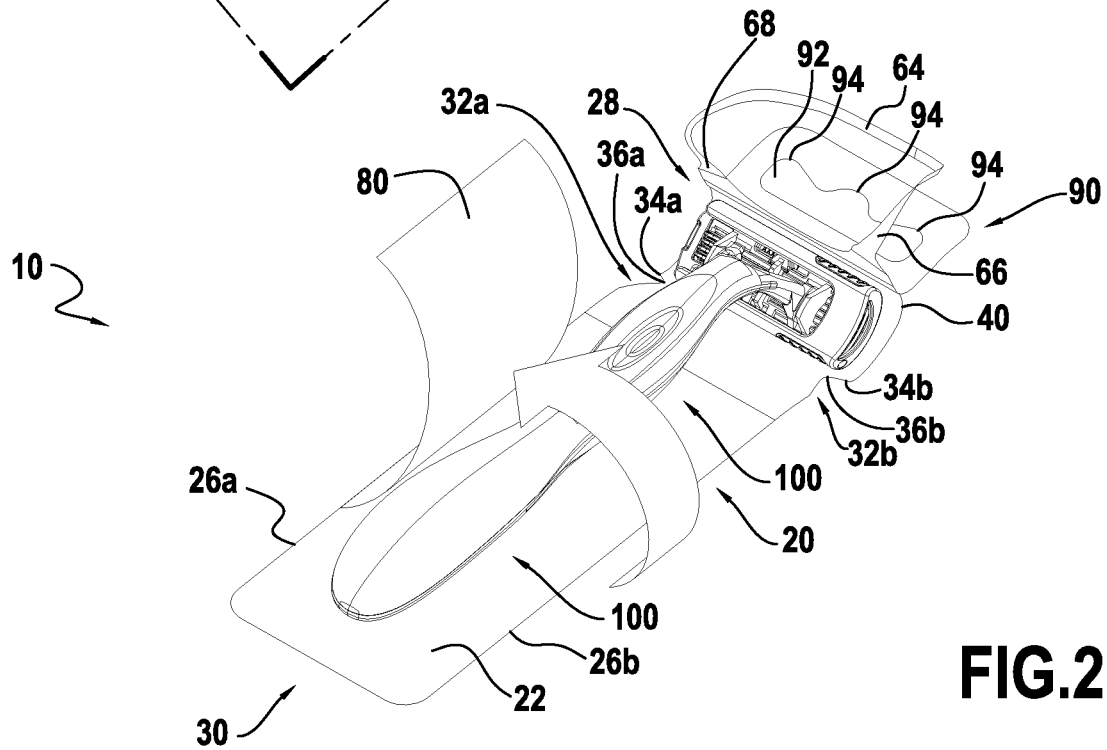
FIG. 2B is a front perspective view of the packaging of FIG. 1A, illustrating a securing member of the packaging being torn away from the packaging.
Figure 3:
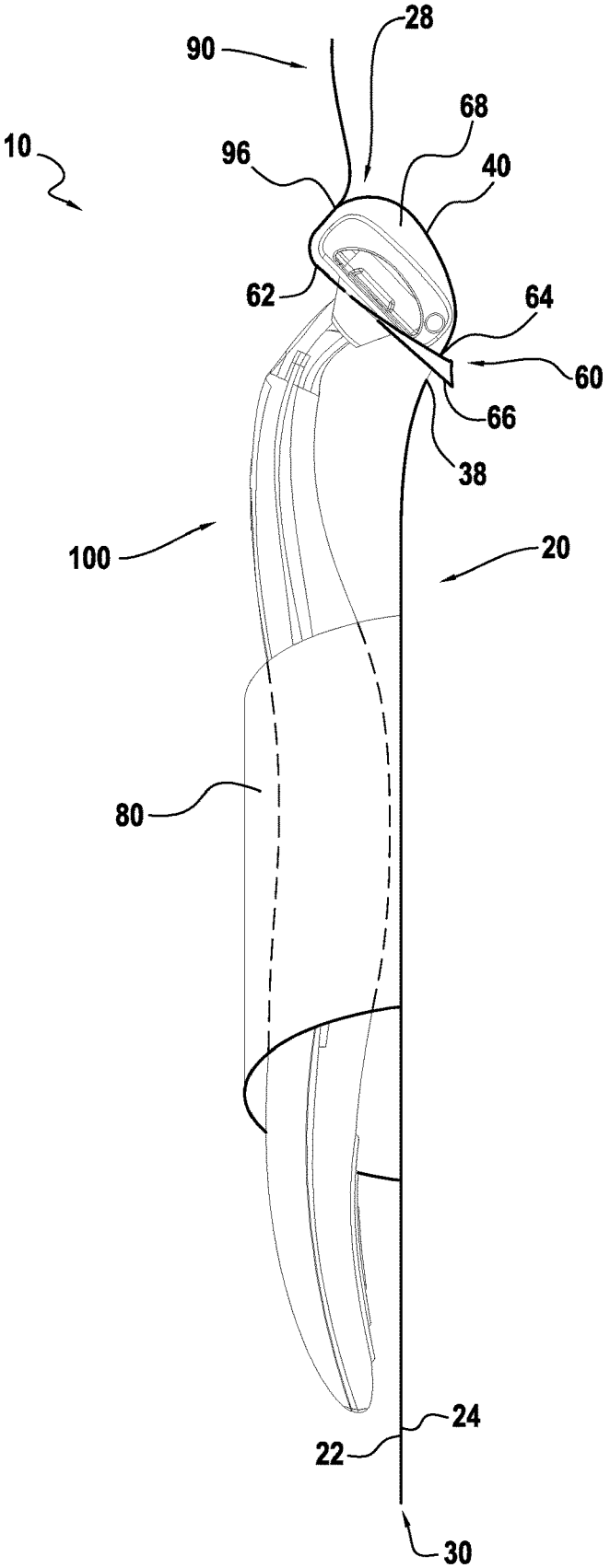
FIG. 3 is a side view of the packaging of FIG. 1A.
Figure 4:
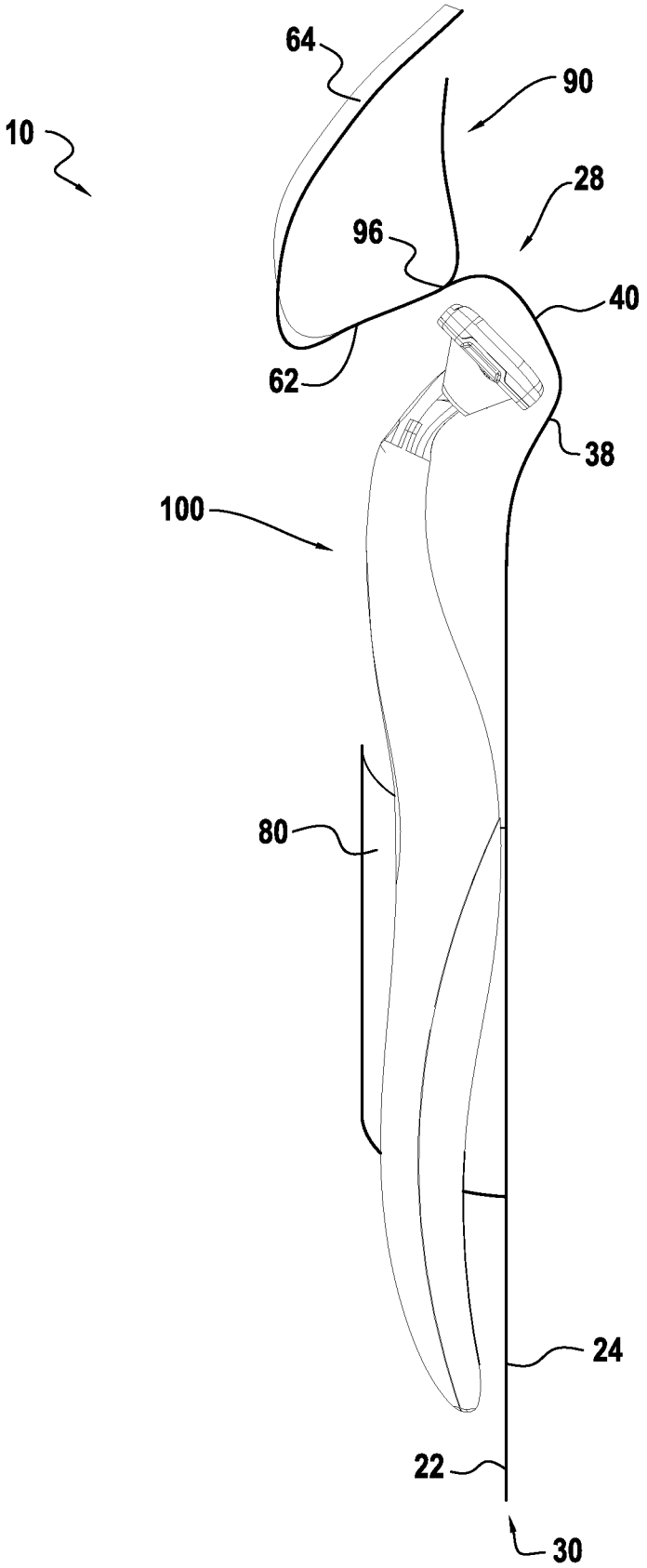
FIG. 4 is a side cross-sectional view of the packaging of FIG. 1A, taken along line IV shown in FIG. 2A.

The packaging 10 is contemplated for use with a product (hereafter, "the product") 100, such as a handheld shaving device. As shown in FIGS. 1A and 1B, the packaging 10 may include a support (wall) 20, a retainer 60, a securing member 80, and a mounting segment 90. The support 20 may be constructed from and/or as one sheet of die-cut material. The securing member 80 may also be constructed from and/or as one sheet of die-cut material. Additionally, the mounting segment 90 may be constructed from and/or as one sheet of die-cut material. However, it is contemplated that two or all three of the support 20, the securing member 80, and the mounting segment 90 may be constructed from and/or as one sheet of die-cut material to reduce the usage of harmful and/or excess materials. In the disclosed embodiment, the material may be recycled paper, however, a person having ordinary skill in the art would understand that other materials, such as non-recycled paper, fiber, foil, cloth, corrugated cardboard, corrugated fiberboard, chipboard, paperboard, plastic, rubber, foam, and metal may be compatible with the packaging 10.

As illustrated by FIGS. 1A-2B, the support 20 may include a first side 22 and a second side 24 extending laterally between a first edge 26*a* and an opposing second edge 26*b* and longitudinally between a proximal end 28 and a distal end 30. At the proximal end 30, the support 20 may define a first indent 32*a* and an opposing second indent 32*b* configured to cooperate with the retainer 60. The term "cooperate" as referred to herein should be understood to generally encompass interactions such as coupling, fastening, mating, affixing, engaging, and/or contacting to further a mechanical effect. Each of the first and second indent 32*a*, 32*b* may include a depth sufficient to hold the retainer 60 in a fixed position about the support 20. The first indent 32*a* may be defined at the first edge 26*a* and the second indent 32*b* may be defined at the second edge 26*b*. The first indent 32*a* may extend inwardly from the first edge 26*a* to a first shoulder 34*a* and the second indent 32*b* may extend inwardly from the second edge 26*b* to a second shoulder 34*b*. Each shoulder 34*a*, 34*b* is configured to impede the retainer 60 from withdrawing from each indent 32*a*, 32*b*. The term "withdraw" or "withdrawn" as referred to herein should be understood to generally encompass a configuration, orientation, and/or movement in which a first element no longer cooperates (as defined above) with a second element. Each shoulder 34*a*, 34*b* may transition further inwardly to a first indent engagement surface 36*a* and a second indent engagement surface 36*b* configured to engage the retainer 60. The second side 24 of the support 20 may also include a support engagement surface 38 configured to engage the retainer 60. It is contemplated that each shoulder 34*a*, 34*b* may also be considered to be part of the first and second indent engagement surfaces 36*a*, 36*b* and configured to engage the retainer 60. In the disclosed embodiment, at least one of the first and second indents 32*a*, 32*b* may include an arcuate contour, however, a person having ordinary skill in the art would appreciate that other contours such as an angled contour may be used for the first and second indents 32*a*, 32*b*. It is further contemplated that the second side 24 of the support 20 may define a third indent 33 at the proximal end 28 configured to cooperate with the retainer 60 and have a structure and functionality similar to the first and second indents 32*a*, 32*b*. The third indent 33 may be included by the packaging 10 as an alternative to the first and/or second indents 32*a*, 32*b* or in combination with the first and/or second indents 32*a*, 32*b*.

Referring to FIGS. 1A-2B, the first side 22 of the support 20 may include the securing member 80 between the proximal and distal ends 28, 30. The securing member 80 may extend from and connect to the first and second edges 26*a*, 26*b*. The securing member 80 is configured to surround and fix the product 100 in position against the first side 22 of the support 20. The securing member 80 may be constructed from the same material as the support 20. Further, the securing member 80 and the support 20 may be constructed from and/or as one sheet of die-cut material or from and/or as two sheets of die-cut material. The securing member 80 may also function as a banner and include noticeable informational text and/or graphics relating to the product 100 to improve the presentation of information related to the product 100. In the disclosed embodiment, the securing member 80 may be polygonal, but a person having ordinary skill in the art would appreciate that other shapes such as an oval, wavy, circular or any other shape such that the securing member 80 may be compatible with the packaging 10.

As shown in FIGS. 1A-4, the retainer 60 may include a base 62 extending to a band 64. The base 62 may be configured to connect the band 64 to the support 20 and be shaped as and/or function as a cradle or support to hold the product 100 against the support 20. In circumstances, the band may have a substantially rectangular cross-sectional shape which may reduce curling of the band within itself. The base 62 and the band 64 may be configured to be elastically deformed so as to be passed from the first side 22 of the support 20 to the second side 24 of the support 20, thereby reducing any difficulty experienced by a user in opening the packaging 10 (see FIG. 5). In the disclosed embodiment, the base 62 and the band 64 may be constructed of an elastomeric material such as caoutchouc (natural) rubber, however, a person having ordinary skill in the art would understand that other flexible and/or polymeric materials such as synthetic rubber, nitrile rubber, silicone rubber, vinyl rubber, and/or neoprene may be compatible with the packaging 10.

The band 64 may include a retainer engagement surface 66 (see FIGS. 2B and 3) configured to engage the first and second indent engagement surfaces 36*a*, 36*b* and the support engagement surface 38. The retainer 60 may be configured to transition between a first position and a second position. In the first position, the band 64 may be within the first and second indents 32*a*, 32*b* and/or on the second side 24 of the support 20, while the base 62 may remain positioned about the first side 22 of the support 20. In the first position, the retainer engagement surface 66 may cooperate with and/or engage the first and second indent engagement surfaces 36*a*, 36*b* and/or the support engagement surface 38. In the second position, the band 64 may no longer cooperate with and/or withdraw from within the first and second indents 32*a*, 32*b* and/or from the second side 24 of the support 20. In the second position, the retainer engagement surface 66 may no longer cooperate with and/or be withdrawn from the first and second indent engagement surfaces 36*a*, 36*b* and/or the support engagement surface 66. In the first position, a cavity 68 (see FIG. 3) may be defined between the first side 22 of the support 20, the base 62, and the band 64. In the first position, the base 62 and the band 64 may engage and/or suspend the product 100 within the cavity 68. In the first position, the base 62 and the band 64 may apply a retention force on the product 100 and press the product 100 against the first side 22 of the support 20 within the cavity 68. To this effect, the support 20 may include a bulge 40 at the proximal end 28 to accommodate the product 100 within the cavity 68. In the second position, the base 62 and the band 64 may no longer engage and/or suspend the product 100 within the cavity 68 and may allow the product 100 to be released and removed from the cavity 68 and thus the packaging 10. The securing member 80 may be torn away from the support 20 (see FIG. 2B) to further enable removal of the product 100 from the packaging 10.

Figure 5:
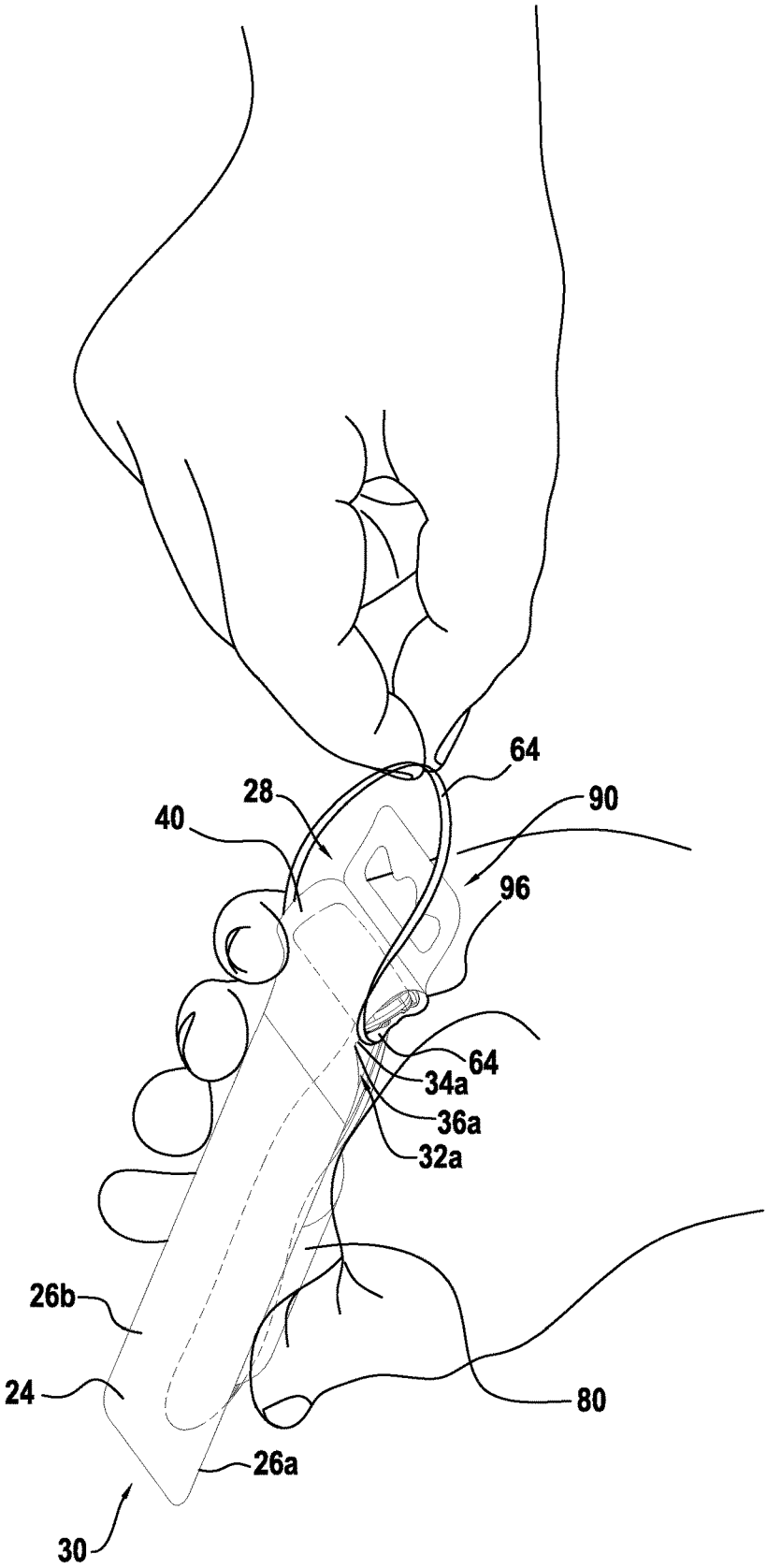
FIG. 5 is a rear perspective view of the packaging of FIG. 1A, illustrating the retainer of the packaging transitioning between a first position and the second position.

As illustrated by FIGS. 1-2B and 4-5, to transition the retainer 60 from the first position to the second position, a user may grasp the band 64 of the retainer 60 between their fingers and proceed to pull the band 64 outwardly and away from the second side 24 of the support 20 (see FIG. 5). Pulling the band 64 outwardly and away from the second side 24 of the support 20 may disengage the retainer engagement surface 66 from the support engagement surface 38. The user may then rotate the band 64 toward and over the proximal end 28 of the support 20, from the second side 24 of the support 20 to the first side 22 of the support 20 (see FIG. 4, wherein it should be understood that the product is not shown in cross-section). Rotating the band 64 and the retainer engagement surface 66 from the second side 24 of the support 20 to the first side 22 of the support 20 may withdraw retainer engagement surface 66 from the first and second indent engagement surfaces 36*a*, 36*b* and the band 64 from the first and second indents 32*a*, 32*b*. Once the retainer engagement surface 66 and the band 64 have been withdrawn from the first and second indent engagement surfaces 36*a*, 36*b* and the first and second indents 32*a*, 32*b*, respectively, the retainer 60 may be in the second position and allow for the product 100 to be released and removed from the cavity 68 and the packaging 10. Reversing this process may transition the retainer 60 from the second position to the first position.

Referring to FIG. 1, the packaging may include the mounting segment 90 at the proximal end 28 of the packaging 10. The mounting segment 90 may function to hang and display the packaging 10 and the product 100 on a display structure (not shown). In the disclosed embodiment, the mounting segment 90 may be substantially flat and define an aperture 92 for receiving the display structure. The aperture 92 may include one or more notches 94 at an upper portion for positioning the mounting segment 90 upon the display structure. The mounting segment 90 may be constructed from the same material as the support 20. Further, the mounting segment 90 and the support 20 may be constructed from and/or as one sheet of die-cut material or be constructed from and/or as two sheets of die-cut material and affixed to each other. In an embodiment where the mounting segment 90 and the support 20 are constructed from and/or as one sheet of die-cut material, the material may be folded at an intersection 96 (see FIGS. 3 and 4) between the mounting segment 90 and the proximal end 28 of the support 20. The base 62 of the retainer 60 may bond to the mounting segment 90 and the support 20 at the intersection 96 between the mounting segment 90 and the support 20. In the disclosed embodiment, the retainer 60 may be thermoglued to the mounting segment 90 and the support 20, however, a person having ordinary skill in the art would appreciate that other methods and materials may be used to bonding and/or affixing the retainer 60 to the mounting segment 90 and the support 20.

The packaging 10 may include a near-field communication (NFC) chip (not shown) embedded in or attached to the securing member 80 or the support 20 to enable communication with an electronic device exterior to the packaging 10 and improve the presentation of information related to the product 100.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

Additionally, all of the disclosed features of an apparatus may be transposed, alone or in combination, to a method and vice versa.

The invention claimed is:

1. A packaging for a product comprising:

a support having a first side and a second side, the first and second sides extending laterally between a first edge and an opposing second edge and longitudinally between a proximal end and a distal end, the support defining a first indent and a second indent, the first indent extending inwardly from the first edge toward a first shoulder and the second indent extending inwardly from the second edge toward a second shoulder, wherein the first shoulder opposes the second shoulder; and an elastomeric retainer formed continuously with and connected to and extending from the support at two separate locations and including an engagement surface, the retainer configured to adopt a first position wherein the engagement surface cooperates with the first shoulder and the second shoulder to define a cavity between the retainer and the first side of the support and a second position wherein the engagement surface no longer cooperates with the first shoulder and the second shoulder, the retainer configured to hold the product within the cavity in the first position and release the product from the cavity in the second position, wherein the retainer includes a base affixed to the support and a band extending from the base, the band being configured to press the product against the first side of the support.

2. The packaging of claim 1, wherein the support extends between a proximal end and an opposing distal end and includes a securing member positioned on the first side of the support between the proximal and distal ends.

3. The packaging of claim 2, wherein the securing member extends from the first edge to the second edge.

4. The packaging of claim 2, wherein the securing member is constructed from the same material as the support.

5. The packaging of claim 1, wherein at least one of the first and second indents includes an arcuate or angled contour.

6. The packaging of claim 1, wherein a second side of the support defines a third indent at the proximal end configured to cooperate with the retainer.

7. The packaging of claim 1, wherein the packaging comprises a mounting segment positioned on and/or above the support, the mounting segment comprising an aperture.

8. The packaging of claim 1, wherein the support includes a bulge at or above the first indent or the second indent.

9. The packaging of claim 1, wherein in the first position of the retainer the engagement surface cooperates with the second side of the support and in the second position of the retainer the engagement surface no longer cooperates with the second side of the support.

10. The packaging of claim 1, wherein the base and the band are configured to be elastically deformed.

11. The packaging of claim 1, further comprising a near-field communication chip embedded in or attached to the support for enabling communication with an electronic device exterior to the packaging and improving the presentation of information related to the product.

12. The packaging of claim 1, wherein the first indent or the second indent includes a depth sufficient to hold the retainer in a fixed position about the support.

13. The packaging of claim 2, wherein securing member is configured to surround and fix the product in a position against the first side of the support.

14. The packaging of claim 1, wherein the base includes an engagement surface and the band is configured to pass over an end of the support thereby transitioning the retainer between a first position in which the engagement surface cooperates with the first indent or the second indent and the support engagement surface to define a cavity between the retainer and the first side of the support and a second position in which the engagement surface no longer cooperates with the first indent or the second indent and the support engagement surface.

15. A packaging for a product comprising:

a support having a first side and a second side, the first and second sides extending laterally between a first edge and an opposing second edge and longitudinally between a proximal end and a distal end, the support defining one or more indents; and a retainer extending from the support and including an engagement surface, the retainer configured to adopt a first position wherein the engagement surface cooperates with the one or more indents to define a cavity between the retainer and the first side of the support and a second position wherein the engagement surface no longer cooperates with the one or more indents, the retainer configured to hold the product within the cavity in the first position and release the product from the cavity in the second position, and a near-field communication chip embedded in or attached to the support for enabling communication with an electronic device exterior to the packaging and improving the presentation of information related to the product.

16. The packaging of claim 15, wherein the packaging comprises a mounting segment positioned on and/or above the support, the mounting segment comprising an aperture.

17. The packaging of claim 15, wherein the one or more indents include a depth sufficient to hold the retainer in a fixed position about the support.

18. The packaging of claim 15, wherein the retainer includes a base affixed to the support and a band extending from the base, the band being configured to press the product against the first side of the support.

19. A packaging for a product comprising:

a support having a first side and a second side, the first and second sides extending laterally between a first edge and an opposing second edge and longitudinally between a proximal end and a distal end, the support defining one or more indents; and a retainer extending from the support and including an engagement surface, the retainer configured to adopt a first position wherein the engagement surface cooperates with the one or more indents to define a cavity between the retainer and the first side of the support and a second position wherein the engagement surface no longer cooperates with the one or more indents, the retainer configured to hold the product within the cavity in the first position and release the product from the cavity in the second position, wherein the retainer includes a base affixed to the support and a band extending from the base, the band being configured to press the product against the first side of the support, and the base includes an engagement surface and the band is configured to pass over an end of the support thereby transitioning the retainer between a first position in which the engagement surface cooperates with the one or more indents and the support engagement surface to define a cavity between the retainer and the first side of the support and a second position in which the engagement surface no longer cooperates with the one or more indents and the support engagement surface.

* * * * *